United States Patent [19]

Corniea et al.

[11] Patent Number: 4,869,397

[45] Date of Patent: Sep. 26, 1989

[54] ADJUSTABLE FILL MOTOR ASSEMBLY

[75] Inventors: Donald G. Corniea, Inver Grove; Steven J. Marty, Stillwater; David E. McCaleb, Minneapolis, all of Minn.

[73] Assignee: Liquipak International, Inc., St. Paul, Minn.

[21] Appl. No.: 65,903

[22] Filed: Jun. 24, 1987

[51] Int. Cl.[4] ..... B67D 5/08; F01B 31/14

[52] U.S. Cl. ..... 222/63; 222/255; 222/309; 222/381; 222/440; 141/147; 92/13.1; 92/13.2; 417/473

[58] Field of Search ..... 222/63, 309, 333, 496, 222/381, 1, 438, 440, 255; 141/147; 417/473; 92/13.1, 13.2, 13.4, 13.8

[56] References Cited

U.S. PATENT DOCUMENTS

| | | | |
|---|---|---|---|
| 3,514,222 | 5/1970 | Korotkov et al. | 92/13.1 X |
| 3,743,140 | 7/1973 | Saurbrey | 222/63 |
| 3,835,898 | 9/1974 | Leonard | 92/13.1 X |
| 4,091,969 | 5/1978 | Easter et al. | 222/309 |
| 4,337,880 | 7/1982 | Rozmus | 222/440 X |
| 4,369,898 | 1/1983 | Andersson | 222/309 X |
| 4,402,461 | 9/1983 | Mosse et al. | 222/381 X |
| 4,428,511 | 1/1984 | Howell | 222/309 |
| 4,475,666 | 10/1984 | Bilbrey et al. | 222/63 X |
| 4,648,421 | 3/1987 | Chant et al. | 222/108 X |

*Primary Examiner*—Joseph J. Rolla
*Assistant Examiner*—Gregory L. Huson
*Attorney, Agent, or Firm*—Burns, Doane, Swecker & Mathis

[57] ABSTRACT

A control arrangement is provided which permits precise metering of a bellows pump. The control arrangement permits the predetermined setting of an amount of fluid to be dispensed from a single pump or a plurality of pumps. The control system permits a double bellows pump to cooperate with a drive mechanism in order to precisely meter the fluid to be dispensed from the pump by selecting a predetermined amount of fluid from a range of settings of the control mechanism. When a plurality of double bellows liquid dispensing pump units are provided, a plurality of electric motors are arranged to drive an adjustable stop element and provide a limit on the length of stroke of a driving rod connected to the bellows pump. The motors are controlled by a program logic circuit which monitors the degree of movement of the stop elements and controls the motors in response to a preset or selected fill condition.

10 Claims, 2 Drawing Sheets

ADJUSTABLE FILL MOTOR ASSEMBLY

BACKGROUND OF THE INVENTION

1. Field of the Invention

This invention relates to a motor driven adjustable filling assembly for a fluid dispensing apparatus.

2. Description of the Prior Art

U.S. Pat. No. 4,402,461 discloses a liquid-dispensing nozzle having a reciprocating bellows communicating with a fluid inlet arrangement. A driving member is connected to the bellows for reciprocating the bellows and an outlet valve is arranged in the fluid inlet to open and allow the fluid to flow from the bellows during a pressure stroke. An inlet valve is also arranged to open to allow the fluid to flow to the bellows during a suction stroke of the bellows. A second bellows is connected upstream of the inlet valve and the driving member is connected to a section of the fluid inlet between the bellows for reciprocating the section and the inlet valve and, therefore, both of the bellows.

As described in the patent, the driving member is a piston rod and hydraulic or pneumatic ram assembly which acts between a frame member and a bracket of the section. The cylinder of the hydraulic or pneumatic ram is fixed to the frame. A separate ram and piston rod arrangement is provided for each double bellows type fill arrangement. In an initial condition of operation of the device, the valve member 43 would be in the closed position and both of the bellows 30 and 35 would be full of liquid to be fed to the dispensing nozzle 37 and then to a carton C below the nozzle.

The ram 42 displaces the bracket 40 upwards from its rest position. The pressure of the liquid in the bellows 30 on the inlet valve 33 opens the valve against the action of a closing spring 33' and the liquid flows into the bellows 35 as the ducting section 32 moves upwards and compresses the bellows 30. When the ram 42 reaches its upper end position and begins to return downward, the valve 33 will automatically close and the liquid in the bellows 35 is pressed by the ram 42 against a driving part 46. Some of the liquid will pass through gaps 54 and 56; however, the rate of flow through the gaps is not enough to prevent a significant increase of pressure on the driving part 46 so that the ram member 42 moves downward against the action of the spring 48 until the driving part 46 abuts against the lugs 52 and limits any further downward movement of the member 43. Under the pressure of the ram 42, the liquid in the bellows 35 continues to flow through the gaps 54 and 56.

From the foregoing description of operation, it can be appreciated that the driving ram 42 and associated piston 41, of the prior art machine does not act to control the amount of liquid received by the upper bellows 30. Accordingly, the device operates at a disadvantage of not being able to preset the stroke of the piston and ram assembly so as to preselect a desired amount of fluid to be directed to an uppermost ducting or fluid inlet section.

SUMMARY OF THE INVENTION

In view of the aforedescribed limitations and shortcomings of the prior art drive units for liquid dispensers, as well as other disadvantages not specifically mentioned above, it should be apparent that, prior to the present invention, there existed a need for a precise control of a double bellows liquid dispensing unit. It is, therefore, a primary object of this invention to provide such a device.

It is an object of this invention to provide a control mechanism for a double bellows pump that cooperates with a drive mechanism to permit a bellows pump to precisely meter the fluid to be dispensed.

Yet another object of the present invention is to provide a control mechanisms that may be preset within a predetermined range of settings so as to select a predetermined amount of fluid to be dispensed by a double bellows pump.

It is a further object of the present invention to provide a control mechanism for a bellow liquid dispensing pump, which may be of the double bellows type, that will permit a plurality of such control units and mechanisms to be used in conjunction with a plurality of double bellows liquid dispensing units.

The aforementioned and other objects are accomplished according to the present invention by providing a control system in which a plurality of electric motors are arranged to drive an adjustable stop element and to provide a limit on the length of stroke of a driving rod connected to a double bellows pump. The motors are controlled by a programmed logic circuit which monitors the degree of movement of the stop elements and controls the motors in response to a preset or selected fill condition.

BRIEF DESCRIPTION OF THE DRAWINGS

Preferred embodiments of the present invention will be described in greater detail with reference to the accompanying drawings, wherein like elements are identified by like reference numerals and wherein.

DETAILED DESCRIPTION OF THE INVENTION

Figure 1:
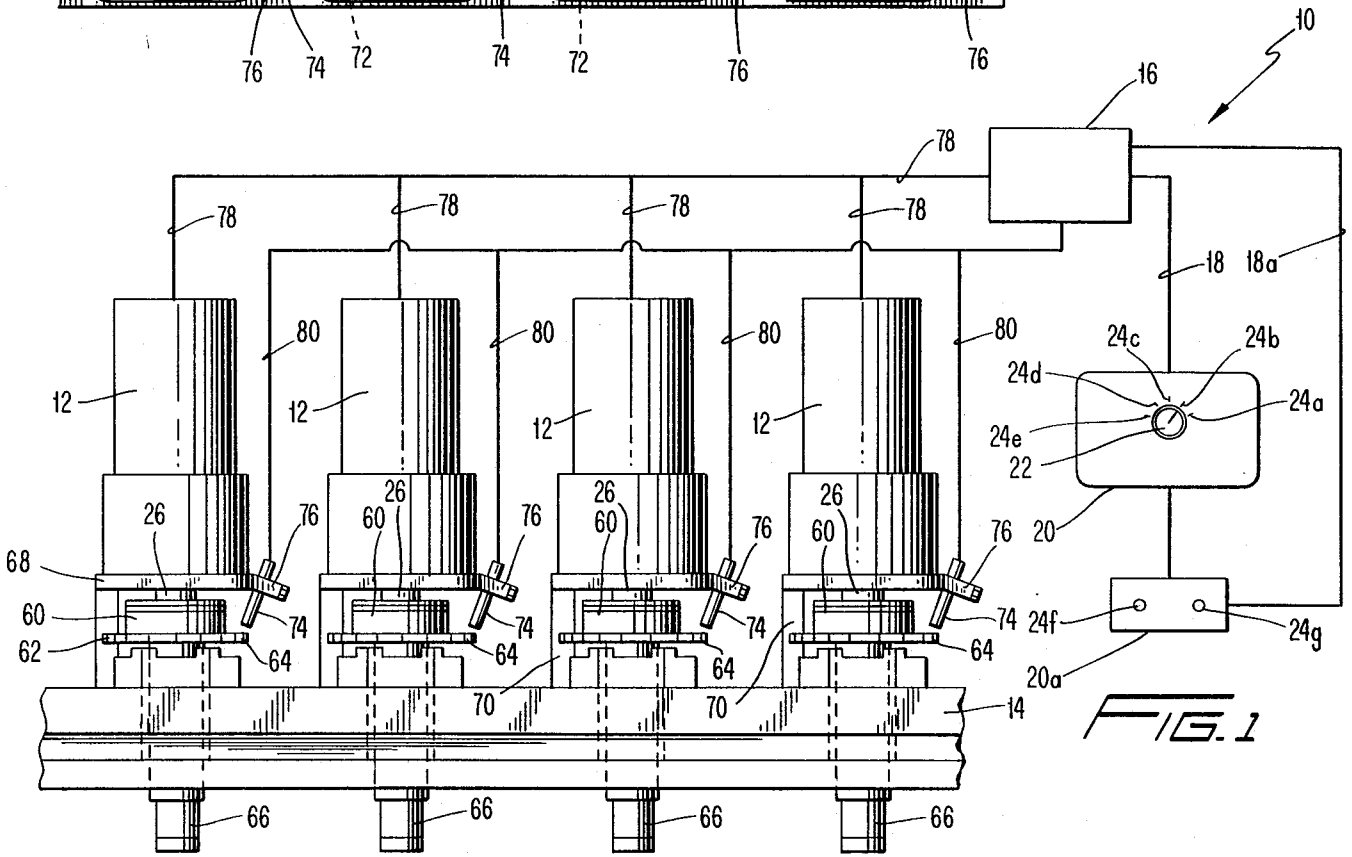
FIG. 1 is a schematic representation of the control system and motor arrangement according to the present invention.

FIG. 1 shows the flow regulator and control system indicated generally at reference numeral 10. A plurality of electric motors are indicated at reference numeral 12 and supported on a support frame 14. The motors 12 are connected in parallel with a programmable logic circuit 16 by a relay circuit, discussed later, and a power supply (not shown). The circuit 16 is in turn connected via leads 18 to a control panel 20. The control panel 20 is provided with a selector element 22 for selecting a predetermined amount of fluid to be dispensed by the bellows pump 28 to a carton C. Indicia for setting the selector 22 are shown at reference numerals **24*a*, 24*b*, 24*c*, 24*d* and 24*e*. As an example, selector setting 24*a* may correspond to a carton filling level of 200 milliliters; selector mark 24b could correspond to a carton filling setting of 250 milliliters; selector mark 24*c* could correspond to a carton filling setting of 300 milliliters; selector mark 24*d* could correspond to a carton filling setting of 500 milliliters and selector mark 24*e*** could correspond to a carton filling setting of 600 milliliters. The foregoing are given merely as examples. Each electric motor 12, when energized, drives a shaft 26. The shaft 26 is fixedly connected to a sprocket 60. The sprocket 60 is provided with an enlarged diameter portion 62 having toothed elements 64. The shaft 26 extends through the sprocket parts 60 and 62 to connect (in any well known manner) with an externally threaded screw member 66.

Figure 2:
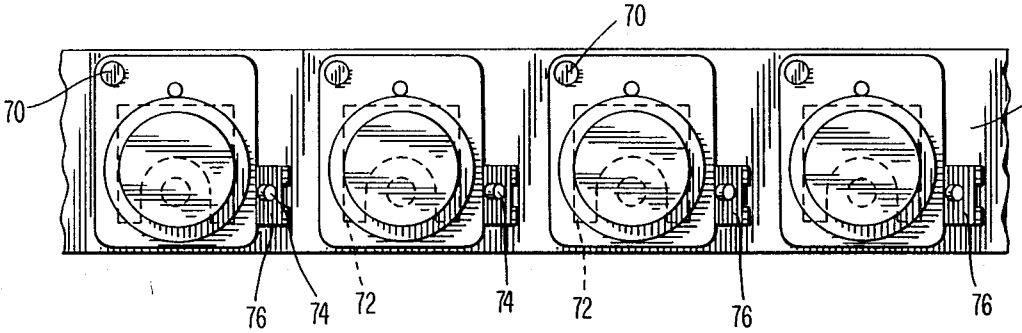
FIG. 2 is a top view of the motor arrangement.
Figure 3:
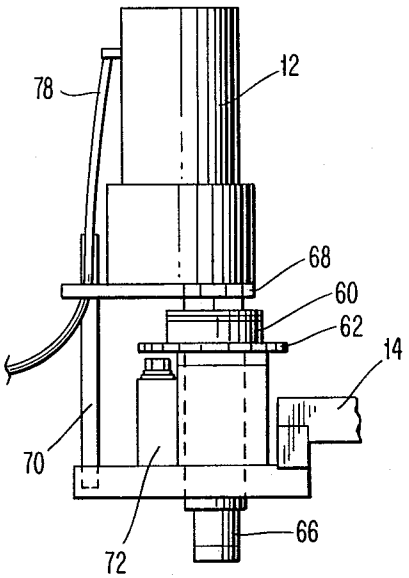
FIG. 3 is a detail, side view, of a single one of the electric motors and stop elements shown in FIG. 1.

The motor 12 is connected to platform 68 by a section of the motor housing in any well known manner. The platform 68 is prevented from rotating by its connection to an upstanding element 70 fixedly connected to the stationary frame member 14. The threaded member 66 is threadly engaged with the frame member 14 so as to support the motor 12 thereon. As shown in FIG. 2 and 3, adjustor stop element 72 is provided on the frame member 14 so as to prevent the electric motor from moving the drive shaft 26 and associated stop screw member 66 beyond a predetermined adjustment position.

An inductive proximity sensor is associated with each of the motors 12. The proximity sensor 74 is positioned on the frame 68 by a support 76.

The motors 12 are connected to a relay circuit which is controlled by the programmable logic circuit 16 and also controlled by a switch arrangement, which may be of the pushbutton type and which is connected in parallel to each of the motors 12. The switch arrangement permits fine adjustment of the motors in a manner to be discussed in detail below. The sensor 74 is connected to the programmable logic circuit 16 by circuit 80.

Figure 4:
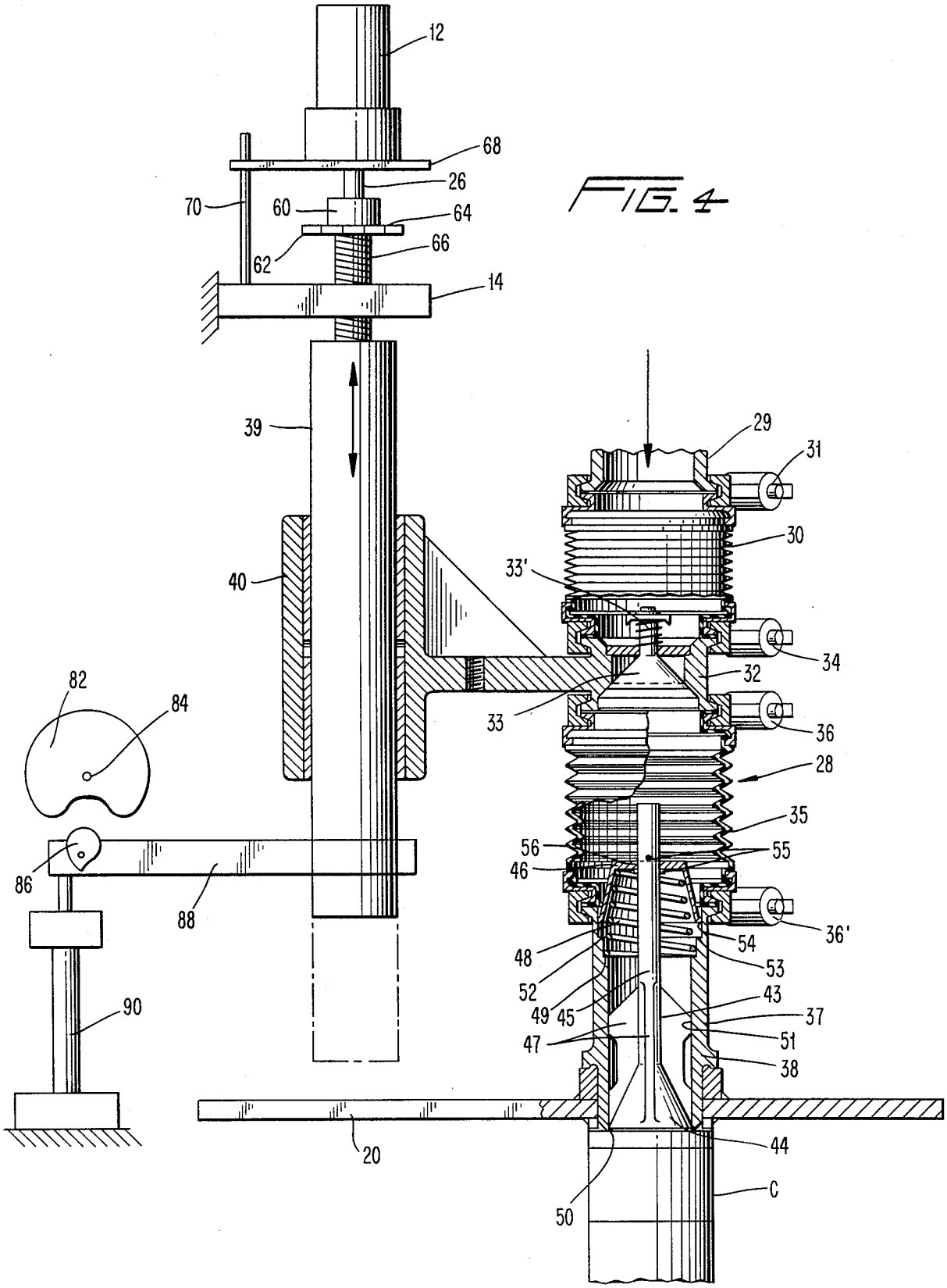
FIG. 4 is a side view showing one of the electric motors and stop elements of the present invention as utilized with a driving device for a double bellows pump.

The double bellows pump arrangement 28 is more clearly shown in FIG. 4 along with a partial schematic view of a single one of the drive motors 12 and adjusting arrangements previously discussed. A drive mechanism for the dispensing unit is also shown therein. The double bellows pump arrangement is shown generally at 28 and has an uppermost ducting or fluid inlet section 29 connected to a supply tank (not shown). An upper bellows 30 is attached at its upper end to a section 29 by a clamp 31. A lower ducting section 32 containing a non-return inlet valve 33 is attached at its upper end by means of a clamp 34 to the bellows 30. A lower bellows 35 is connected at its upper end by means of a clamp 36 to the section 32. A nozzle 37 is connected at its upper end by means of a clamp 36' to the bellows 35. The bellows 30 and 35 may be of suitable plastic material and formed in a conventional manner. The nozzle 37 includes a vertical tubular housing 38 fixed in the mounting frame 20. A driven piston member 39 is fixedly connected to a bracket 40 which is integral with the ducting section 32. A separate driven piston member 39 is provided for each vertical double bellows pump 28. Arranged coaxially in each housing 38 is a valve member 43 which consists of a closure part 44, a vertical central stem 45 extending upwardly from the part 44, a driving part 46 of inverted cup shape attached to the upper end of the stem 45 and four vertical fin elements 47 extending upwardly from the closure part 44 and arranged to slide on the internal surface of the housing 38 in order to guide movement of the valve member 43 in the housing 38.

A spiral compression spring 48 acts between an internal, upwardly facing shoulder 49 of the housing 38 and the base of the inverted cup shape part 46 urges the valve 43 into the closed position shown in FIG. 4. An outer peripheral edge zone of the closure part 44 bears directly against a corresponding valve seat 50 formed at the lower extremity of the internal surface of the housing 38. The fins 47 terminate as closely as possible to the outer peripheral end zone of the closure part 44 and leave an adequate seating area. The internal surface of the housing 38 continues upward as a circular cylindrical bore surface 51 and then as the upwardly facing surface of the shoulder 49. A short distance above the shoulder 49 is on upwardly facing shoulder 52. Arranged on the shoulder 52 are upstanding lugs 53 integral with the housing which serve as abutments and cooperate with the outer peripheral edge zone of the part 46 to provide a positive limit to the maximum extent of opening of the valve member 43 and thus defines the fully open position of the member 43. Between the outer peripheral edge zone of the part 46 and the internal surface of the housing 38 is an annular gap or clearance 54 through which liquid can flow. The part 46 is attached to the stem 45 by means of pins 55 fixed in radially holes in the stem 45. There is also an annular gap or clearance 56 through which liquid can flow between the part 46 and the stem 45.

The driving arrangement for the driven piston member 39 includes a rotary cam 82 mounted for rotation about a fixed axis 84 adjacent the driven piston member 39. A cam follower 86 is mounted for movement with driving element 88 fixedly connected to the driven piston member 39. A cylinder 90 is connected to the driven member 88 and is a no-container, no-fill cylinder of the type disclosed in applicant's copending application entitled METHOD AND DEVICE FOR DRIVING DOUBLE BELLOWS PUMP, filed Apr. 20, 1987.

Oscillation of the double bellows pump is provided by the rotary cam 82 which engages a cam follower 86. The cam 82 is mounted on a shaft, (shown schematically) for rotation about the axis 84 and is driven by a variable speed motor (not shown). When the cam follower 86 engages with the surface of the cam 82, the cam surface has a dwell that is greater than 180° which displaces the double bellows pump 28 in a downward position. During the remaining rotation of the cam and follower arrangement, the cam permits the follower 70 to move upward along with the plate number 88 and which permits the pump unit 28 to be moved.

The speed at which the cam 82 rotates determines the frequency at which the double bellows dispensing unit operates. Further, the movement of the cam 68 determines the length of the stroke of the tubular body 16 which in part determines the flow rate of liquid through the nozzle of the double bellows pump. Accordingly, the stroke of the double bellows pump will be equal to the amount of eccentricity of the cam 82.

In operation, the selector lever 22 on the control panel 20 is preset to one of the previously described positions 24*a* through *e*. The level of fluid to be filled into a carton C is then transmitted to the programmable logic circuit via the lead 18. The programmable logic circuit actuates the electric motors 12 so as to drive the shaft 26 and sprockets 60 and 62 and screw thread member 66. Accordingly, the screw thread member 66 will be moved in a direction so as to allow increased or decreased driving stroke of the driven piston member 39. If it is assumed that a larger carton size such as the 500 to 60 milliliter size, previously discussed, has been selected, the programmable logic circuit unit 16 will actuate the electric motor so as to retract the screw thread 66 and allow for increased driving stroke of the driven piston member 39. The adjustment of the screw thread 66 is monitored by the proximity sensor 74 which senses the number of teeth 64 which have passed under the sensor 74. The sensor 74 sends a signal along lead 80 to the programmable logic circuit so that the circuit 16 may control and monitor the duration of energization to the electric motors 12. The proximity sensor 74 will continually sense the amount of rotation of the sprocket 62 by monitoring the rotational movement of the teeth. This signal is sent to the programmable logic circuit 16. When the number of turns or rotation of the gear 64 is sensed which corresponds to the predetermined and preselected amount of fluid to be filled in the carton C, the programmable logic circuit 16 will deenergize the electric motors 12 so as to cease further movement of the stop element or screw thread member 66.

Once a filling amount has been selected on the panel 20 and the screw thread member 66 adjusted for allowing stroke of the driven piston element 39, the bellows 30 and 35 are filled with liquid in a conventional manner. A series of open cartons C, only one of which is shown in FIG. 4, are arranged on a conveyor underneath the nozzle 37. The no-container no-fill cylinder 90 is then actuated by, for example, pressurized air, to move the cam follower 86 vertically until the follower 86 engages in the cam surface 82. A motor, not shown, drives shaft 84 and rotates the cam 82 at a constant speed. The surface of the cam 82 causes the cam follower 86 and the driven member 88 to reciprocate in a vertical direction. As shown, in FIG. 4, the driven member 88 is fixedly connected to the driven piston member 39. The driven piston member 39 will reciprocate in a vertical direction up to the limit set by the stop screw member 66. As the bracket 40 is fixedly connected to the driven piston member 39, the vertical reciprocation imparts a corresponding reciprocating movement to the bellows.

The fine fill adjustment mechanism is indicated at reference numeral **20*a* and consists of two push button type switches 24*f* and 24*g*. The push button type switches send a signal along relay line 18*a* to the programmable logic circuit 16 so as to provide for a fine adjustment of the amount of fluid delivered to the cartons c. The fine fill adjust permits the manual adjustment of the screw member 66 of one or more fill motors 12 after the automatic changeover by the automatic programmable logic circuit 16. The fine fill adjust permits the operator to initiate a manual change subsequent to the PLC putting all motors 12 and screw members 66 into one common predetermined position, i.e., a position determined by the selector switch 22. The selector switch 22, as previously explained, selects a predetermined fill amount of liquid to be filled into the carton c. After some sample cartons have been run through the machine and filled with the amount selected by the selector lever 22, the sample cartons will be weighed. Upon weighing of the cartons, there may be a need for adjusting one or more of the fill stations controlled by the electric motors 12. The adjustment may be necessary so as to correct any overweight or underweight of the amount of the material pumped into the carton by the double bellows pump. The fine fill adjustment 20 permits the manual adjustment of the motors 12** so as to compensate for differences between desired theoretical weight and overfill or underfill deviations from the desired theoretical weights.

In order to accomplish the foregoing, the fine fill adjustment pushbutton **24*f* may be for example a pushbutton which permits the adjustment of one of the motors 12 so as to permit more products to be added to the carton while the pushbutton 24*g* may be a button which permits the manual adjustment of a motor 12 so as to permit less fill material to be pumped into the carton. As a typical example, the first and last stations, i.e., the far left and far right motor stations of FIG. 1 will be provided with a set of fine fill adjustment pushbuttons. When activated, the pushbuttons 24*f* and 24*g* will send a signal to programmable logic circuit 16 so as to activate the relay 78 and energize one of the motors 12 in one direction or the other, i.e., up or down. A display, not shown, may be provided so as to give a visual indication of change in position of the thread member 66** during fine fill adjustment procedures. During the fine fill adjustment procedures, the programmable logic circuit disables the proximity sensor arrangement from operation so as to prevent correction of adjustment position which would otherwise occur.

When it is desired to change carton size, the foregoing procedure would then be repeated with regard to selecting a new carton size, setting the screw members 66 to determine the length of stroke of the driven piston member and subsequent starting the cam drive for the double bellows pump. Of course, it should be recognized that as the control system is wired in parallel, one or a plurality of the electric motors could be used so as to control only one or more of the driven piston members. Of course, the number of motor and driven piston units would correspond to the number of double bellows pumps utilized in a filling operation.

Although the present invention has been described herein in the context of its application with a pump dispensing system, it will be appreciated that other applications of the present invention are possible. Furthermore, the references to the directions of movements of the various elements are intended as exemplary and not limiting. Thus, although a preferred embodiment is illustrated and described herein, modifications and variations of the present invention are possible in light of the above teachings and with the purview of the appended claims without departing from the spirit and intended scope of the invention.

What is claimed is:

1. A flow regulator for a liquid dispensing apparatus comprising:

a plurality of rotatable stop elements each having a range of linear movement; a plurality of motor means connected to said stop elements for adjusting said linear movement; control means connected to said plurality of motor means for controlling actuation of said plurality of motor means and including a fine adjustment control means; sensor means mounted on said motor means for detecting rotational movement of said stop elements and developing a signal in response to said rotational movement; signal transfer means connected between said control means and said sensor means for adjusting said control means; selector means for selecting a predetermined degree of said linear movement from said range of linear movement; said signal being transmitted to said control means and said control means adjusting said motor means to position said adjustable stop elements to said predetermined degree of movement and, said fine adjustment control means includes control switches for controlling energization of said motor means to override a setting of said selector means.

2. The apparatus of claim 1, wherein said each of said plurality of motors are individually controllable.

3. The apparatus of claim 1, wherein said sensor means includes a gear member connected to said adjustable stop element and a proximity switch detector; said motor means actuatable to drive said adjustable stop element so as to control the amount of liquid to be dispensed from said liquid dispensing apparatus.

4. The apparatus of claim 3, wherein said proximity switch detector counts movement of gear teeth of said gear member driven by said motor means and develops a signal indicative of variations in said linear movement.

5. A flow regulator for a liquid dispensing apparatus comprising:

adjustable stop means for predetermining an amount of liquid to be dispensed by the liquid dispensing apparatus; motor means for controlling the adjustable stop means; control means for controlling said motor means and including a fine adjustment control means; sensor means connected to said adjustable stop means for sensing a predetermined degree of movement of said adjustable step means; feedback control means connected between said sensor means and said control means for controlling said control means; selector means for selecting a predetermined position of the stop means; a plurality of said adjustable stop means and a plurality of said motor means being provided; said control means being connected in parallel to each of said plurality of motors with each of said plurality of motors being individually controllable; and, said fine adjustment control means includes control switches for energizing said motor means to override a setting of said selector means to adjust the position of said stop means.

6. The apparatus of claim 5, wherein said adjustable stop means are adjustable within a predetermined range of movement so as to provide a measured quantity of the dispensed liquid; said selector means includes a selector switch for selecting the amount of liquid to be dispensed.

7. The apparatus of claim 5, wherein said sensor means includes a gear member connected to said adjustable stop means and a proximity switch detector; said motor means actuatable to drive said adjustable stop means and adjust linear movement of the stop means.

8. The apparatus of claim 7, wherein said proximity switch detector counts movement of gear teeth of said gear member driven by said motor means and develops a signal indicative of variations in position of said stop means.

9. Apparatus comprising a plurality of feeding means arranged to feed fluid, each said feeding means including ducting, a reciprocatory bellows communicating with said ducting, a driving member connected to said bellows for reciprocating said bellows, an outlet valve in said ducting arranged to open to allow the fluid to flow from the bellows during a pressure stroke, and an inlet valve arranged to open to allow the fluid to flow to the bellows during the suction stoke thereof, a second bellows connected upstream of said inlet valve, and said driving member being connected to a section of said ducting between the bellows and carrying said inlet valve for reciprocating said section and said inlet valve and thus both of the bellows, the improvement comprising; flow regulator means for limiting movement of said driving member and selecting a predetermined range of movement of the driving member corresponding to a predetermined amount of fluid to be dispensed by said feeding means; said flow regulating means including a plurality of stop elements each having a range of movement; a plurality of motor means connected to said stop elements for adjusting said movement; control means connected to said plurality of motor means for controlling actuation of said plurality of motor means including fine adjustment control means; sensor means mounted on said motor means for detecting rotational movement of said stop elements and developing a signal in response to said rotational movement; and, selector means for selecting a predetermined degree of said movement from said range of movement; said fine adjustment control means having control switches for energizing said motor means for overriding a setting of said selector means; signal transfer means connected between said control means and said sensor means for adjusting said control means.

10. The apparatus of claim 9, wherein said each of said plurality of motors are individually controllable.

* * * * *